US005388524A

United States Patent [19]

Strandli et al.

[11] Patent Number: 5,388,524

[45] Date of Patent: Feb. 14, 1995

[54] PRACTICE PROJECTILE

[76] Inventors: Kare R. Strandli, Lyngv. 5; Inge M. Angard, Froyslandsv. 25, both of 2830 Raufoss, Norway

[21] Appl. No.: 975,078

[22] Filed: Nov. 12, 1992

[51] Int. Cl.[6] ..... F42B 8/14

[52] U.S. Cl. ..... 102/529; 102/506; 102/513; 102/517

[58] Field of Search ..... 102/395, 444, 498, 502, 102/506, 517, 518, 529, 513

[56] References Cited

U.S. PATENT DOCUMENTS

| | | | |
|---|---|---|---|
| 3,898,933 | 8/1975 | Castera et al. | 102/529 |
| 3,972,291 | 8/1976 | Braun, Jr. et al. | 102/513 |
| 4,242,960 | 1/1981 | Boeder et al. | 102/529 |
| 4,362,107 | 12/1982 | Romer et al. | 102/529 |
| 4,553,482 | 11/1985 | Weber et al. | 102/529 |
| 4,716,835 | 1/1988 | Leemans | 102/529 |
| 4,854,242 | 8/1989 | Katzmann | 102/517 |
| 5,027,710 | 7/1991 | Wittman et al. | 102/513 |

FOREIGN PATENT DOCUMENTS

| | | | |
|---|---|---|---|
| 407288 | 1/1991 | European Pat. Off. | 102/498 |
| 2529663 | 1/1984 | France | 102/517 |
| 3404411 | 8/1985 | Germany | 102/529 |
| 4038371 | 6/1992 | Germany | 102/513 |

*Primary Examiner*—Harold J. Tudor
*Attorney, Agent, or Firm*—Bacon & Thomas

[57] ABSTRACT

A practice projectile free of any explosive or bursting charge, adapted for shooting from aircraft against ground targets or for other kinds of practice shooting and comprising a hollow shell, a projectile base and a nose portion which engages the shell along a circumferential partition therebetween, wherein the base is a separate part relatively to the shell, whereby a circumferential partition between the base and the shell is formed. The base is fastened to or made integral with a rod or a tube which extends centrally and axially through the shell and is fastened to or made integrally with the nose portion, whereby the rod or tube keeps the projectile together as a unit, and the rod or tube, or a fastening member thereof situated on the nose portion, has a weakened portion which axially is situated approximately at the level of the partition between the shell and the nose portion.

7 Claims, 1 Drawing Sheet

PRACTICE PROJECTILE

BACKGROUND OF THE INVENTION

The present invention relates to a practice projectile free of any explosive or bursting charge, adapted for shooting from aircraft against ground targets or for other kinds of practice shooting. The projectile comprises a hollow shell, a projectile base and a nose portion which engages the shell along a circumferential partition therebetween.

Practice shooting from aircraft against ground targets is partly performed from a relatively small height. The shooting partly takes place against targets in such a small distance ahead of the aircraft that the aircraft cannot avoid passing over the target area. In order to reduce the costs of the practice shooting, projectiles without any explosive or blasting charge are normally used, which means that the projectile is not necessarily broken up into small fragments in the target. Consequently, there is a great danger that ricochets of a relatively large size can be returned upwardly from the target area, and this will happen just in the period when the aircraft, having shot the projectile or projectiles passes over the target area. The aircraft, therefore, is in danger of being hit by the ricochets. The ricochets can comprise complete projectiles or large fragments thereof, and the aircraft hull can be seriously damaged and the crew can be in great danger. This problem may be avoided by not flying below a certain minimum height which is larger than the height which the ricochets can reach, but this means that the practice shooting will not be very realistic, because the shooting must cease at such a great distance from the target that the shooting does not correspond to shooting by use of live ammunition. When live ammunition is used, the projectiles will be broken into small fragments in the target area, and the fragments can only return to a small height, without causing any danger to the aircraft.

Also, by other kinds of practice shooting, it may be desirable or necessary to ensure that the range or height of ricochets is limited, for instance in order that they do not spread beyond the boundary of a shooting field.

Different solutions of the problem of ricochetting practice projectiles have been proposed. Projectiles have been made from pressed iron shavings, in order to pulverize upon impact in a target. This solution involves the problem that the projectiles may pulverize during firing from a weapon, due to the large acceleration forces to which the projectiles are subjected. On the other hand, if the projectiles are manufactured with a large or reasonable degree of safety against pulverizing during firing, the projectiles may not even pulverize upon impact in the target. Another attempt consists of making practice projectiles partly or entirely of plastics. This solution leads to a problem with respect to the mass of the projectiles relative to live projectiles. It is desirable that the practice projectiles should have approximately the same mass as corresponding live projectiles, taking into account the ballistic properties. Moreover, the plastics may be overheated or melt in hot gun barrels. This is a safety problem. It must be taken into consideration that the shooting may take place with a very high firing rate (automatic weapons) and consequently with a high generation of heat.

U.S. Pat. No. 146,036 describes a subcaliber projectile having a mainly massive projectile body with weakening portions which cause splitting up of the projectile body. The projectile does not comprise any hollow shell or a separate nose portion.

SUMMARY OF THE INVENTION

The present invention relates to a practice projectile which, in a simple and little expensive manner, solves the problem of ricochetting up to a height which brings the aircraft in danger, and which simultaneously secures the necessary strength of the projectile during firing.

In a practice projectile according to the invention the base is a separate part relatively to the shell, and a circumferential partition between the base and the shell is formed, whereby the base and the shell abut each other around the circumference. The base is fastened to or made integral with a rod or a tube which extends centrally and axially through the shell and is fastened to or made integrally with the nose portion, whereby the rod or tube keeps the projectile together as a unit. The rod or tube, or a fastening member thereof situated on the nose portion has a weakened portion which axially is situated approximately at the level of the partition between the shell and the nose portion.

Thus, the practice projectile according to the invention comprises two partitions, and prior to and during firing the projectile is kept together as a unit by means of the rod or tube. Upon impact against a target, and in particular an inclined impact, the weakened portion of the rod or tube or its fastening member will burst. Thereby, the projectile is divided into units, each of which having of course a smaller mass than the complete projectile, and each of which having substantially poorer ballistic properties than the complete projectile. The air resistance or drag acting against each of the units will to a large degree limit the height to which the units can be brought by ricochetting from a target area. During practice shooting from aircraft, the firing can take place similarly as during shooting of live ammunition, i.e. that the aircraft can shoot against ground targets also from small heights and distances and shortly after the firing pass over the target area, without danger of being hit by ricochetting projectiles. Therefore the invention makes it possible to limit the spreading of ricochets.

A projectile according to the invention can be given the same shape, mass and mass distribution as live ammunition, and without any problems the projectile can be made with such a mechanical strength that it can withstand firing from a gun or firing as a self-propelled missile.

BRIEF DESCRIPTION OF THE DRAWING

The invention will hereinafter be explained more detailed, with reference to the accompanying drawing, which shows non-limiting examples of embodiments of a practice projectile according to the invention.

DESCRIPTION OF EMBODIMENTS

Figure 1:
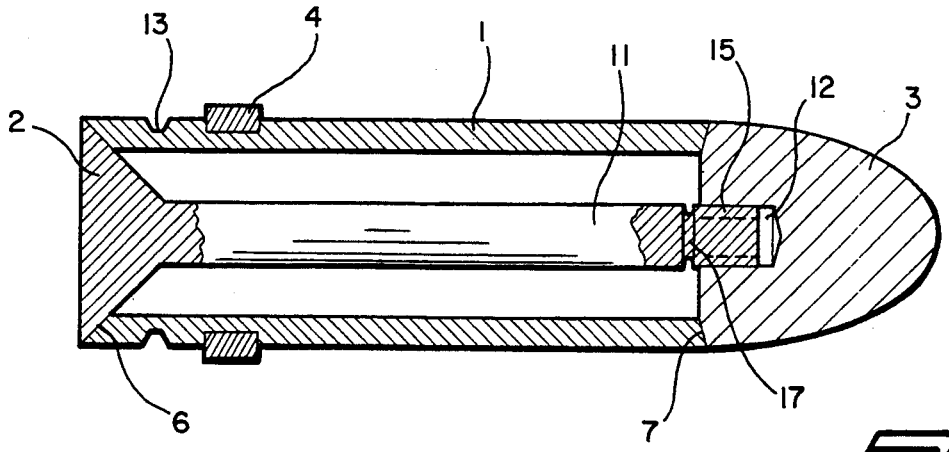
FIG. 1 shows a longitudinal section through a first embodiment of a projectile according to the invention.

Each of the Figs. shows a practice projectile comprising a shell 1, a nose portion 3 and a base 2, whereby a rod or tube 11 connects the nose portion 3 and the base 2. The base 2 constitutes a separate part relatively to the shell 1. The base 2 and the shell 1 abut each other along a partition 6. Also the shell 1 and the nose portion 3 are separate parts which abut each other along a partition 7. Thus, the rod or tube 11 keeps the projectile together as a unit prior to and during firing and also in the flight towards a target.

In the embodiment of FIG. 1 a rod 11 is made integrally with the base 2, and the rod has a threaded end portion 15 which has been screwed into a threaded bore 12 in the nose portion 3. In order to ensure proper engagement in the partitions 6 and 7, the bore 12 may be somewhat longer than the end portion 15 screwed into it.

Figure 2:
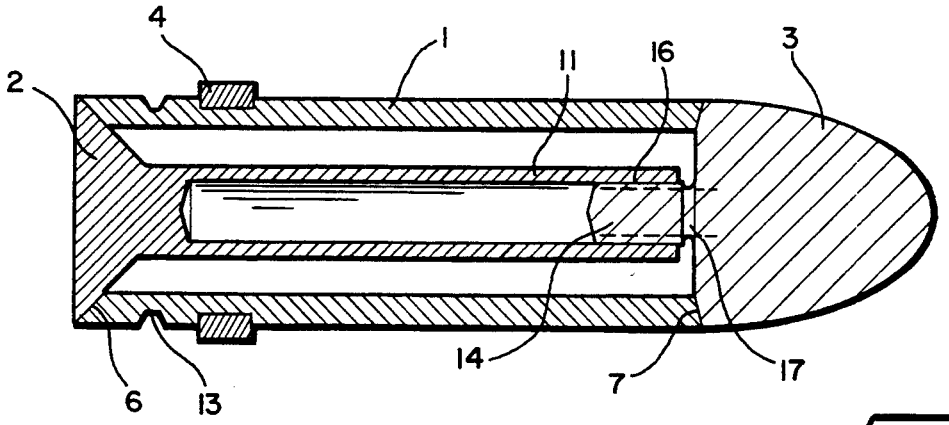
FIG. 2 shows a longitudinal section through a second embodiment of the projectile.

In the embodiment of FIG. 2 a tube 11 is made integrally with the base 2, and the nose portion 3 comprises a threaded stud 14 which has been screwed into a threaded end portion 16 of the tube 11.

Figure 3:
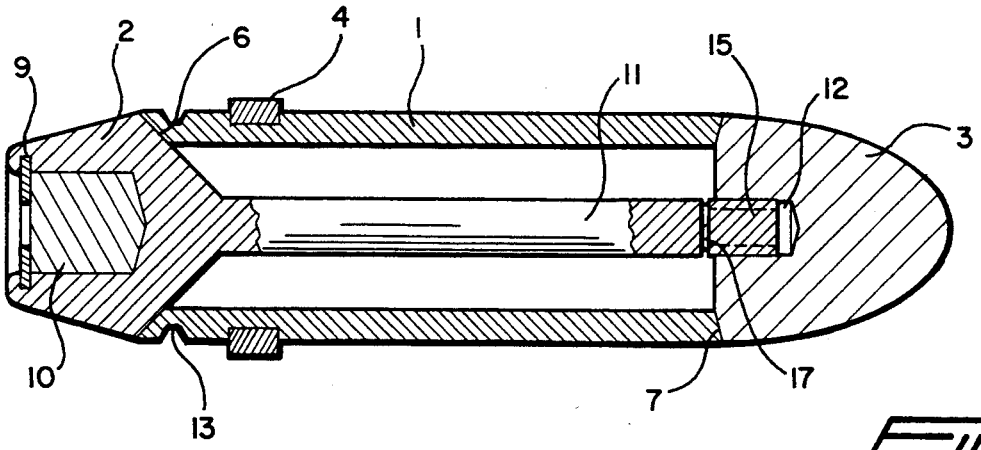
FIG. 3 shows a longitudinal section through a third embodiment of the projectile.

The embodiment of FIG. 3 is similar to the embodiment of FIG. 1 with respect to the connection between the base 2 and the nose portion, in that a rod 11 has been screwed into a threaded bore 12 in the nose portion 3. In this embodiment the base 2 comprises a rearwardly open recess which contains a tracer charge 10, and the recess is partly closed by means of a disc 9 which retains the charge 10 in the recess and has a central aperture.

In all of the embodiments shown the shell 1 is in a conventional manner equipped with a guiding band 4, and moreover the shell has a circumferential groove 13 for fastening of a cartridge case by clamping or deforming the case into the groove. All of the projectiles shown are cartridge case ammunition, but it will be understood that the invention is not limited to this type of ammunition.

In the embodiment of FIG. 2 the tube 11 extends in the entire distance between the nose portion 3 and the base 2. However, more or less of the tube length may be in the form of a massive rod, for instance in order to increase the mass of the projectile towards one of the ends thereof.

The partitions 6 and 7 may be conical, in order to cause mutual alignment of the components of the projectile.

If the projectiles, having an annular hollow space between the shell 1 and the rod or tube 11, have a smaller mass than live projectiles, the hollow space can be filled for instance with a granular material, such as for instance metal shavings or sand, in order to adjust the mass.

In a projectile according to the invention, the rod or tube 11 or the stud 14 shown in FIG. 2 is dimensioned to burst when the projectile hits a target under an acute angle after having been fired from an aircraft in a relatively small height, in a downwardly inclined direction, or after having been fired under other kinds of practice shooting. For instance the threads of the rod 11 shown in FIG. 1 or 3 or the threads of the stud 14 shown in FIG. 2 may constitute a weakened area which will burst when the projectile hits a target. Of course the rod or tube 11 or the stud 14 may comprise another kind of weakening means, such as one or more circumferential grooves 17. Tests will have to be carried out in order to determine whether the weakened area actually bursts under the shooting conditions which the projectiles are to be used.

When the weakened area bursts the projectile will no longer be kept together as a single unit. In the embodiment of FIG. 1 the nose portion 3, possibly together with a portion of the rod 11, will constitute a first unit, the shell 1 will constitute a second unit and the base 2 and the rod 11 or a remainder of the rod will constitute a third unit.

In the embodiment of FIG. 2, provided that the stud 14 is the part which bursts, the nose portion 3 will constitute a first unit, the shell 1 will constitute a second unit and the base 2, the tube 11 and the stud 14 (or the major portion of the stud) will constitute a third unit. In this embodiment the weakened area may also be situated on the tube 11, near or around the stud 14.

In the embodiment of FIG. 3 the same units as in the embodiment of FIG. 1 will be constituted, the only difference being that the base 2 in the embodiment of FIG. 3 comprises the recess for the tracer charge 10. The charge 10 will of course have combusted partly or completely during the flight of the projectile.

Each of the above mentioned units will have poor ballistic properties, compared with a complete projectile. Each unit has a mass which is substantially smaller than that of the complete projectile. The unit constituted by the shell 1 is an open tube, and when the velocity of this unit decreases the unit will at a certain velocity be unstable and not be able to move in a ballistic path, and the unit will then fall relatively steeply to the ground.

Thus, upon an impact against a target the projectile will be divided into units which are not able to ricochet in a path of the same height or in the same range as a complete projectile.

The invention is not limited to full caliber ammunition. The projectile can be a sub-caliber projectile on which a sabot is mounted for the firing, whereby the sabot is discarded immediately when free of the gun barrel. The invention can also be used for self-propelled missiles, such as rocket propelled practice grenades. In the latter case the base 2 may have a tail portion equipped with fins.

All the components of a projectile according to the invention except from a tracer charge or a propulsion charge may be made of steel or metal. As a non-limiting example the shell, the rod or tube and the base may be made of steel and the nose portion may be made of a light alloy, for instance an aluminium alloy.

We claim:

1. An explosive-free practice projectile adapted to disintegrate only upon impact with a target without the use of any charges comprising:

a hollow shell having first and second axially spaced ends;

a nose portion engaging the first end of said hollow shell along a first circumferential partition, said nose portion including an axially extending, internally threaded bore that opens into said hollow shell; and a base engaging the second end of said hollow shell along a second circumferential partition, said base including a rod fixedly secured thereto, said rod extending axially, centrally through and being radially spaced from said hollow shell and terminating in an externally threaded end that is formed with a weakened portion, said threaded end being threadably received within the internally threaded bore of said nose portion for securing said hollow shell, said nose portion and said base, which are formed as separate parts, together with said weakened portion being situated adjacent said first circumferential partition.

2. An explosive-free practice projectile according to claim 1, further including a tracer charge housed within said base.

3. An explosive-free practice projectile according to claim 1, wherein said first and second circumferential partitions are conical.

4. An explosive-free practice projectile according to claim 1, wherein said weakened portion is defined by a circumferential groove formed about said threaded end.

5. An explosive-free practice projectile adapted to disintegrate only upon impact with a target without the use of any charge comprising:

a hollow shell having first and second axially spaced ends;

a-nose portion engaging the first end of said hollow shell along a first circumferential partition, said nose portion including an axially extending, externally threaded stud that terminates within said hollow shell; and a base engaging the second end of said hollow shell along a second circumferential partition, said base including a tube fixedly secured thereto, said tube extending axially, centrally within and being radially space from said hollow shell and terminating in an internally threaded end, at least one of said threaded stud and said internally threaded end being formed with a weakened portion, said internally threaded end being threadably secured to said externally threaded stud for securing said hollow shell, said nose portion and said base, which are formed as separate parts, together with said weakened portion being situated adjacent said first circumferential partition.

6. An explosive-free practice projectile according to claim 5, wherein said first and second circumferential partitions are conical.

7. An explosive-free practice projectile according to claim 5, wherein said weakened portion is defined by a circumferential groove formed about said externally threaded stud.

* * * * *

UNITED STATES PATENT AND TRADEMARK OFFICE

CERTIFICATE OF CORRECTION

PATENT NO. : 5,388,524

DATED : February 14, 1995

INVENTOR(S) : Strandli et al.

It is certified that error appears in the above-indentified patent and that said Letters Patent is hereby corrected as shown below:

COLUMN 1

Line 66, "U.S. Patent No. 146,036" should read --NO Patent No. 146,036--.

COLUMN 5

Line 15, "a-nose" should read --a nose--.

COLUMN 6

Line 3, "space" should read --spaced--.

Signed and Sealed this

Thirteenth Day of June, 1995

*Attest:*

*Attesting Officer*

BRUCE LEHMAN

*Commissioner of Patents and Trademarks*